US009824840B2

(12) United States Patent
Schwartz et al.

(10) Patent No.: US 9,824,840 B2
(45) Date of Patent: Nov. 21, 2017

(54) MECHANICAL DISCONNECT SWITCH WITH INTEGRATED FUSE PROTECTION

(71) Applicants: Geoffrey Schwartz, Stoughton, MA (US); Dana Scribner, Tyngsboro, MA (US); Joe Thomas, Reading, MA (US)

(72) Inventors: Geoffrey Schwartz, Stoughton, MA (US); Dana Scribner, Tyngsboro, MA (US); Joe Thomas, Reading, MA (US)

(73) Assignee: Littelfuse, Inc., Chicago, IL (US)

( * ) Notice: Subject to any disclaimer, the term of this patent is extended or adjusted under 35 U.S.C. 154(b) by 637 days.

(21) Appl. No.: 14/478,416

(22) Filed: Sep. 5, 2014

(65) Prior Publication Data

US 2016/0071678 A1 Mar. 10, 2016

(51) Int. Cl.
*H01H 71/12* (2006.01)
*H01H 85/044* (2006.01)
(Continued)

(52) U.S. Cl.
CPC ..... *H01H 71/122* (2013.01); *H01H 69/02* (2013.01); *H01H 85/044* (2013.01); *H01H 85/2045* (2013.01); *H01R 9/245* (2013.01); *H01H 85/143* (2013.01); *H01H 2085/025* (2013.01); *H01H 2085/208* (2013.01); *H01R 4/34* (2013.01); *H01R 4/56* (2013.01); *H01R 11/12* (2013.01); *H01R 13/684* (2013.01); *H01R 2201/26* (2013.01)

(58) Field of Classification Search
CPC ..... H01H 71/122; H01H 85/044; H01H 85/2045; H01H 69/02; H01H 85/143; H01H 2085/025; H01H 2085/208; H01R 9/245; H01R 4/43; H01R 4/56; H01R 11/12; H01R 13/684; H01R 2201/26
See application file for complete search history.

(56) References Cited

U.S. PATENT DOCUMENTS 3,985,977 A * 10/1976 Beaty ..... H04B 5/0075 455/351
7,172,462 B1 2/2007 Gronowicz, Jr.
(Continued)

FOREIGN PATENT DOCUMENTS

DE 9409851 U1 8/1994

OTHER PUBLICATIONS

European Search Report dated Jan. 19, 2016, in corresponding application No. EP15183700.2.

*Primary Examiner* — Zeev V Kitov

(57) ABSTRACT

A circuit protection assembly (CPA) is disposed between a source of power and a circuit to be protected. The CPA comprises a mounting block having a bore extending therethrough and a recess cavity on a first surface of the mounting block. A post having a first end is disposed within the recess cavity and a body portion extends through the bore. The body portion configured to receive a terminal and the second end configured to receive a securing mechanism. A fuse having a centrally disposed aperture is configured to receive the body portion of the post and to receive the terminal for connection to a circuit to be protected. An insulator disposed on the terminal and disposed beneath the securing mechanism. The insulator configured to isolate the post from the terminal and the fuse while allowing the securing mechanism to apply an amount of torque.

11 Claims, 4 Drawing Sheets

(51) Int. Cl.

| | |
|---|---|
| ***H01H 85/20*** | (2006.01) |
| ***H01H 69/02*** | (2006.01) |
| ***H01R 9/24*** | (2006.01) |
| *H01H 85/143* | (2006.01) |
| *H01H 85/02* | (2006.01) |
| *H01R 4/34* | (2006.01) |
| *H01R 4/56* | (2006.01) |
| *H01R 11/12* | (2006.01) |
| *H01R 13/684* | (2011.01) |

(56) References Cited

U.S. PATENT DOCUMENTS

| | | | | |
|---|---|---|---|---|
| 7,924,137 | B2 * | 4/2011 | Rahman | H01H 85/044 337/158 |
| 2004/0018417 | A1 * | 1/2004 | Stack | H01H 85/044 429/61 |
| 2009/0066469 | A1 | 3/2009 | Rahman | |

* cited by examiner

MECHANICAL DISCONNECT SWITCH WITH INTEGRATED FUSE PROTECTION

FIELD OF THE INVENTION

Embodiments of the invention relate to the field of circuit protection devices. More particularly, the present invention relates to a mechanical disconnect switch integrated with fuse protection using a fuse assembly employing a post arrangement that is easier to manufacture and provides a built-in insulating configuration with the fuse.

DISCUSSION OF RELATED ART

Fuses are used as circuit protection devices and form an electrical connection between a power source and a component in a circuit to be protected. In particular, a fuse may be configured to protect against damage caused by an overvoltage and/or overcurrent condition. A fuse is constructed to physically open or interrupt a circuit path and isolate electrical components from damage upon the occurrence of specified overvoltage and/or overcurrent conditions in the circuit. Also, in certain applications where high current fuses are needed, these fuses may be positioned close to relays and battery disconnect switches. This requires holders, wires and connections to accommodate such fuses which adds size, cost and complexity to the electrical circuit within a limited footprint. If the primary fusing can be added directly to the product, it will simplify installation, lower cost and increase reliability by eliminating unnecessary connections as well as reducing valuable space requirements. It is with respect to these and other considerations that the present improvements have been needed.

SUMMARY OF THE INVENTION

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Exemplary embodiments of the present disclosure are directed to a protection device disposed between a source of power and a circuit to be protected. In an exemplary embodiment, a circuit protection assembly employs a post arrangement including a built-in insulating fuse configuration for mechanical disconnect. The circuit protection assembly is disposed between a source of power and a circuit to be protected. The circuit protection assembly comprises a mounting block having a bore extending therethrough and a recess cavity on a first surface of the mounting block. A post having a first end is disposed within the recess cavity and a body portion extends through the bore. A fuse having a centrally disposed aperture is configured to receive the body portion of the post. The post having a second end, which may be defined having a top and bottom portion. The bottom portion of the second end receives a terminal for connection to a circuit to be protected. An insulator is disposed on the terminal, which is connected to the bottom portion, and the insulator is disposed beneath a securing mechanism. The insulator isolates the second end of the post from the terminal and the fuse while allowing the securing mechanism to apply an amount of torque.

DETAILED DESCRIPTION OF EMBODIMENTS

Figure 1B:
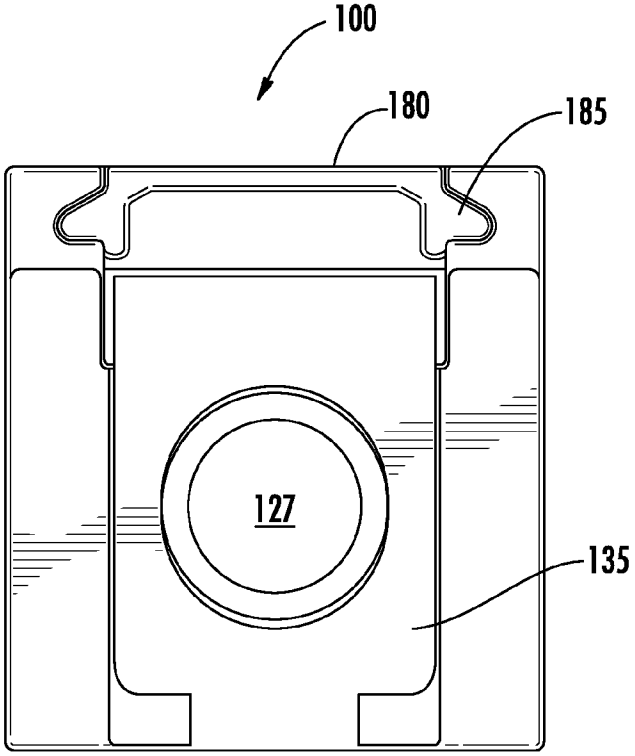
FIG. 1B is a top plan view of a fuse utilized in an assembly in accordance with an embodiment of the present disclosure.

The present invention will now be described more fully hereinafter with reference to the accompanying drawings, in which preferred embodiments of the invention are shown. This invention may be embodied in many different forms and should not be construed as limited to the embodiments set forth herein. These embodiments are provided so that this disclosure will be thorough and complete, and will fully convey the scope of the invention to those skilled in the art. In the drawings, like numbers refer to like elements throughout.

Electrical systems in vehicles typically include a number of circuit protection devices to protect electrical circuitry, equipment, and components from damage caused by various abnormal conditions. For example, power sources (e.g. batteries) in vehicles utilize a fuse fitted over a terminal post to which a ring terminal of an electrical cable is connected. A nut is usually threaded onto the post to keep the ring terminal and fuse in position. When an overvoltage condition occurs causing excess current to be supplied in the circuit, the fuse protects the components connected to the power source from this excess current. Unfortunately, shorting may occur when the ring terminal comes into direct electrical contact with the post instead of through the fuse, which causes excessive current to reach and damage the components.

Accordingly, there is a need to provide a fuse assembly that includes a post or terminal portion that is easier to manufacture and provides an insulating configuration to prevent unnecessary short circuits. In addition, in many cases high current fuses are needed for primary fusing close to relays and battery disconnect switches. This requires added holders, wires and connections that add size, cost and complexity to an installation. If the primary fusing can be added directly to the product, it will simplify installation, lower cost and increase reliability by eliminating unnecessary connections.

An effective way to eliminate these extra components is by using a fuse assembly that isolates a bolt so that the bolt has no electrical function at all, and to prevent plastic creep under the bolting mechanical load using a high glass content washer that is not subject to the creep effect exhibited by plastics. In one embodiment, the bolt may be isolated using a securing mechanism such as, for example, a nut that separates the metal portion of the securing mechanism from the terminal assuring that the correct path through the fuse is completed. Yet, the isolation technique presents additional problems as the securing mechanism requires an outer coat of an insulator making the securing mechanism difficult to properly torque thereby subjecting the securing mechanism to loosening in high vibration applications creating a high resistance connection. In addition when the securing mechanism is removed and misplaced and replaced by a standard nut all the fusing effects are lost.

To overcome these challenges, as illustrated below, an insulator (e.g., a washer), is proximately disposed on a top portion of a terminal, and proximately disposed below a standard securing mechanism such as, for example, a standard nut. The insulator isolates the bolt while allowing the standard nut to have a normal amount of torque applied thereto. The insulator may incorporate a glass mat washer as part of the insulator for handling a compression insert molded into a molded-plastic portion that adds an extrusion to isolate the top of the fuse and the terminal from the bolt.

The molded-plastic portion allows a tether (e.g., a rubber tether) to be attached to the insulator to prevent the insulator from being lost. In one embodiment, the insulator includes the tether, or in an additional embodiment, the insulator can be used absent the tether. The mating terminal design assures that the insulator fits and can also prevent the unit from being used without a fuse. As described herein, the mating terminal design is flexible and simply by changing the shape of the mating terminal, it may be adapted for use with batteries, switches, relays, power distribution modules, fuse holders, jumper studs, generator/alternators, and any other product that uses a stud type power connection.

Figure 1A:
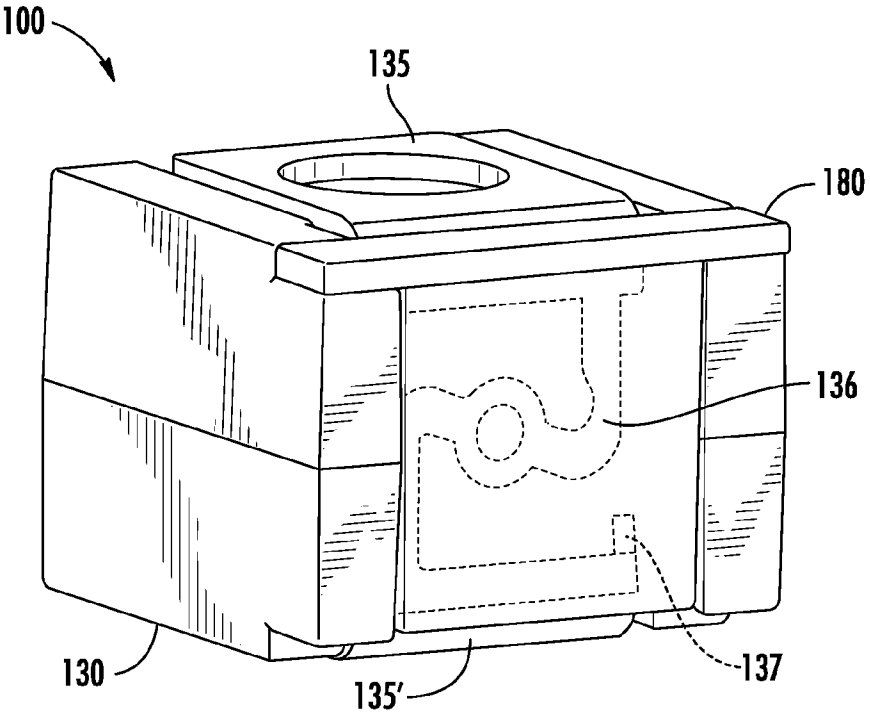
FIG. 1A illustrates an exploded perspective view of a fuse utilized in an assembly in accordance with an embodiment of the present disclosure.

FIG. 1A is a perspective view of an exemplary fuse 100, which may be a fuse assembly, may be utilized for circuit protection in various vehicle applications. Other circuit protection devices may be used consistent with the principles of the present disclosure. Fuse 100 is defined by a fuse element 136 disposed between an upper ring terminal 135 and lower ring terminal 135' and housing 130. The fuse element 136, upper ring terminal 135 and lower ring terminal 135' may be formed from a unitary piece of conductive material to provide an electrical path from a power source to a circuit to be protected. The size, shape and thickness of the fuse element 136 are dependent on the rating of the fuse needed for a particular application. Fuse element 136 may include a retaining flange 137, which extends toward housing 130 to assist in the retention thereof. The housing 130 is made from an insulating material such as, for example, a ceramic material capable of withstanding torque forces associated with connection via a post configuration as described in more detail below. Fuse 100 may also include a cover 180 which extends from the upper ring terminal 135 to the lower ring terminal 135' used to protect the fuse element 136 from ambient particles as well as acting to contain arcing when the fuse element 136 is blown as a result of an abnormal operating condition.

FIG. 1B is a top view of fuse 100 illustrating a centrally disposed aperture 127 through which a post 125, (see FIG. 2A-B) is received. Aperture 127 extends from the upper ring terminal 135 through the lower ring terminal 135'. The cover 180 may be at least partially disposed in grooves 185 of fuse body 100' which helps to retain the cover 180 in position.

Figure 2A:
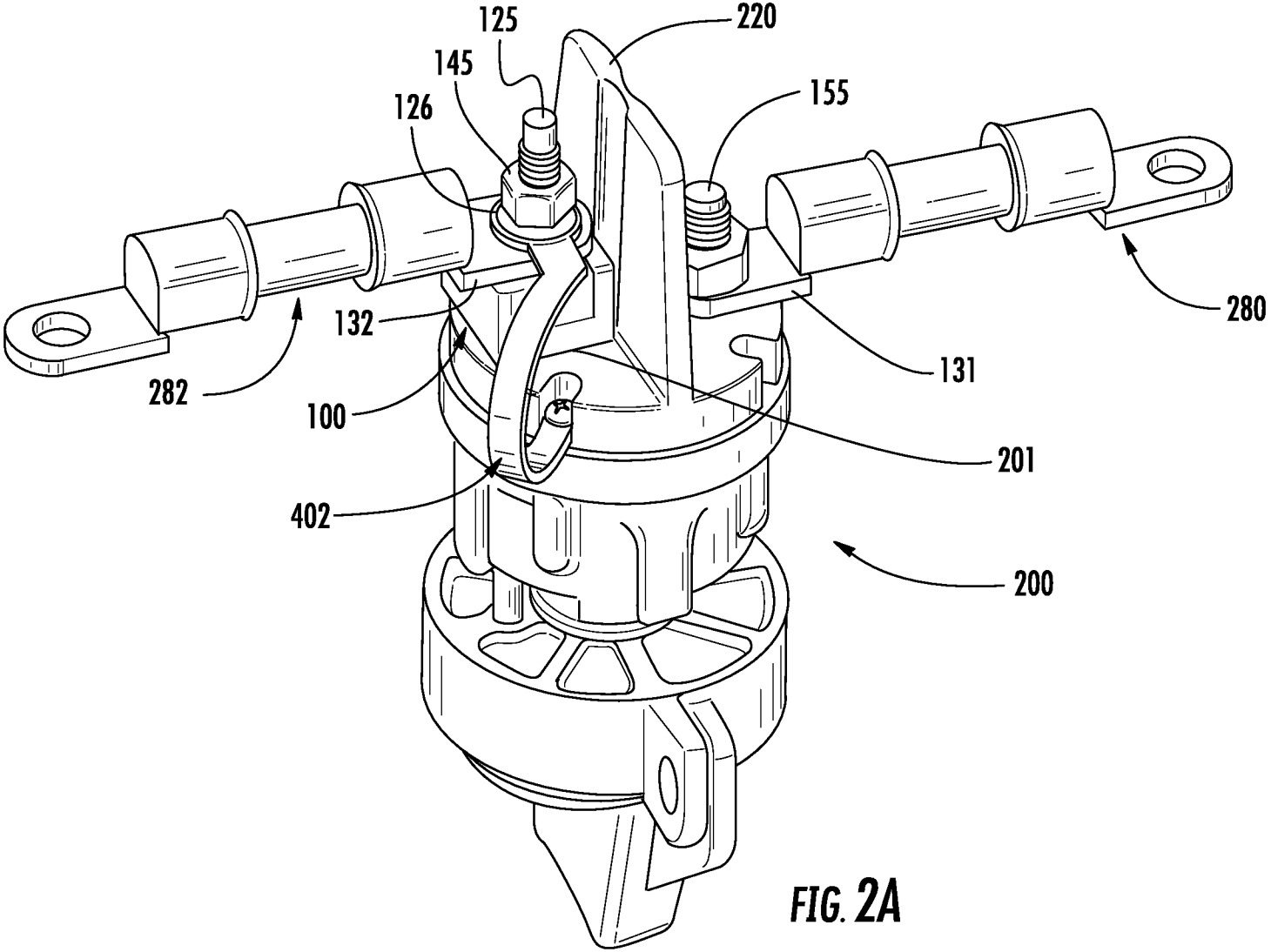
FIG. 2A illustrates an exploded perspective view of a mechanical disconnect with integrated fuse protection using the fuse assembly of FIGS. 1A and 1B.

FIG. 2A is a perspective view of an exemplary mechanical disconnect switch 200 used in various vehicle applications that includes integrated fuse protection using the fuse 100 of FIGS. 1A and 1B. In this illustration, the mechanical disconnect switch 200, isolates a circuit or device after the current has been interrupted by other means. Mechanical disconnect switch 200 may be connected on one side to a power source via cable 280 and first post 155, such as, for example, a bolt, and to a load on a distribution side via cable 282 and a post 125 which may be a considered a second post as compared to the first post 155 depending on the configuration of the mechanical disconnect switch 200. In other words, the first post 155 may be considered a second post in one embodiment, and the post 125 may be considered a first or second post depending on the configuration of the mechanical disconnect switch 200. As such, the first post 155 and the post 125 are depicted herein are shown as example configurations.

In one embodiment, the mechanical disconnect switch is configured as a mounting block to receive post 125 and first post 155. A second bus plate 131 forms the physical and electrical connection between cable 280 and mechanical disconnect switch 200. Similarly, bus plate 132 forms the physical and electrical connection between cable 282 and the mechanical disconnect switch 200. The fuse 100 is disposed on a post 125 via aperture 127 (shown in FIG. 1B) and is secured in place via a securing mechanism 145. Mechanical disconnect switch 200 includes switch assembly 220 which is used to allow current to flow from the power source via cable 280 to the load side via cable 282. In particular, current flows from cable 280 through the mechanical disconnect switch 200 via the second bus plate 131 through platform 201, such as, for example, a conductive platform, and to fuse 100 to cable 282.

In order to prevent current from flowing through post 125, an insulator 126 is disposed between the securing mechanism 145 and the fuse 100. More specifically, the insulator 126 is disposed between the securing mechanism 145 and the bus plate 132. Insulator 126 isolates post 125 from the fuse 100 such that current flows through fuse 100 from the mechanical disconnect switch 200 via platform 201 to bus plate 132 and onto cable 282. The fuse 100 connects to the insulator 126 and a tether 402 (e.g., an attachment means). The tether 402 is coupled to the insulator 126.

The insulator 126 is a separate component and is not molded as part of the fuse 100. In one embodiment, the insulator 126 is proximately superposed (placed on top) on bus plate 132 and proximately disposed beneath the securing mechanism 145. The insulator 126 configured to isolate the bus plate 132 and the fuse 100 from the securing mechanism 145 while allowing the securing mechanism 145 to apply an amount of torque. In one embodiment, the insulator 126 is a washer having a protective layer and may be, for example, a glass mat washer.

Figure 2B:
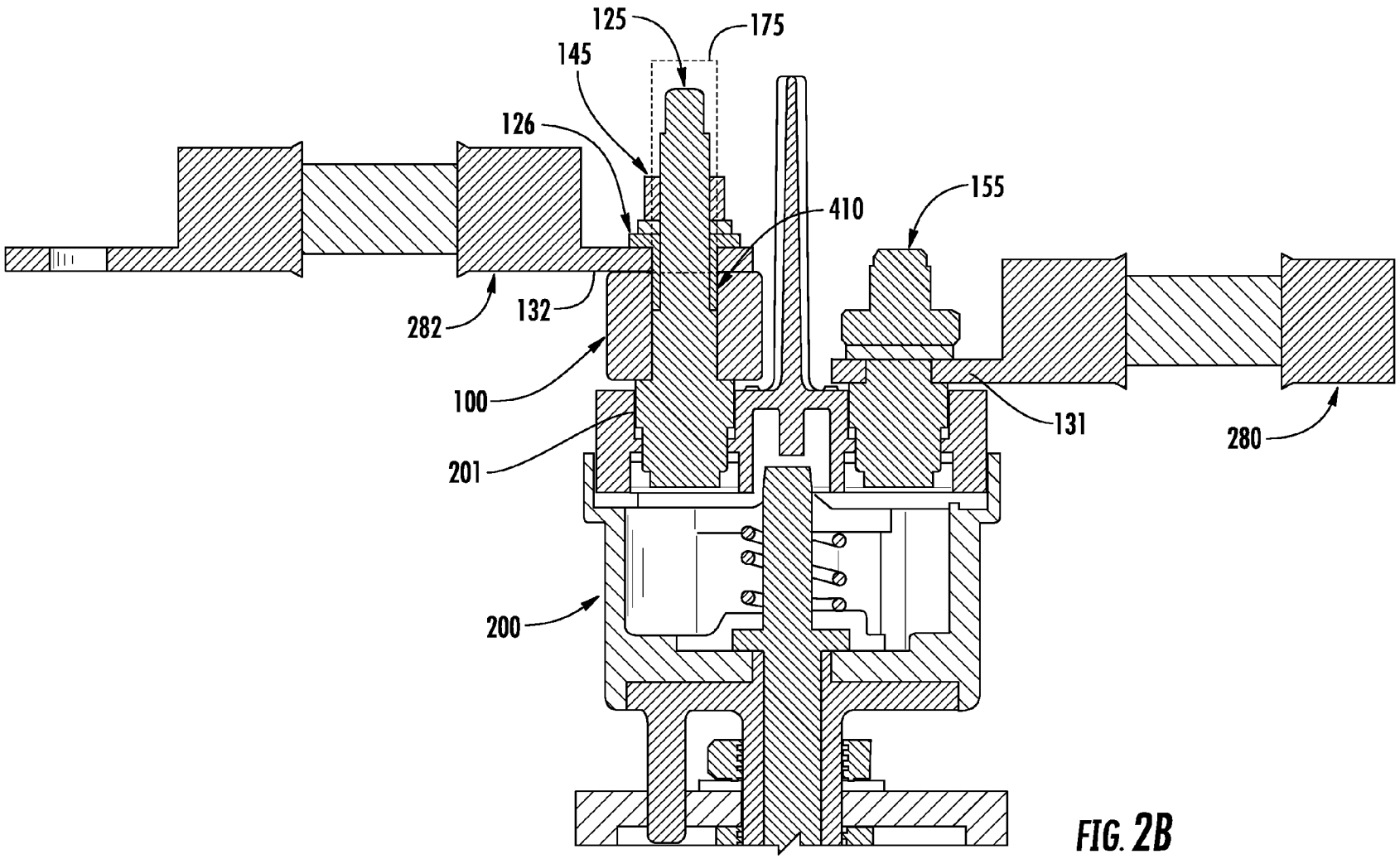
FIG. 2B illustrates an exploded cross sectional view of a mechanical disconnect with integrated fuse protection using the fuse assembly of FIGS. 1A and 1B.

FIG. 2B is a cross-sectional view of an exemplary embodiment of the mechanical disconnect switch 200 used in various vehicle applications that includes integrated fuse protection using the fuse 100 of FIGS. 1A and 1B. The insulator 126 includes an extrusion portion 410 (e.g., molded extension means) extending along a portion of the post 125. In one embodiment, the centrally disposed aperture 127 of the fuse 100 receives all or a portion of extrusion portion 410. As the extrusion portion 410 extends along a portion of the post 125, the extrusion portion 410 isolates the portion of the post 125 from the bus plate 132 (or terminal). Thus, only a portion, if any, of the post 125 not being sounded or encased by the extrusion portion 410 makes contact with the fuse 100. In other words, the fuse element 136, the upper ring terminal 135 and/or lower ring terminal 135' of the fuse are isolated from the post 125 such that current flows through fuse 100 from the mechanical disconnect switch 200 via platform 201 to bus plate 132 and onto cable 282 so as to provide an electrical path from a power source to a circuit to be protected. Thus, the current flows from cable 280 through the mechanical disconnect switch 200 via second bus plate 131 and a platform connection 201 to fuse 100 to bus plate 132 to cable 282.

To prevent current from flowing through all or at least a portion of the post 125, the insulator 126 is disposed between securing mechanism 145 and bus plate 132, which may also be a terminal. Because the securing mechanism 145, such as, for example, a threaded nut is mounted over and on top of the insulator 126, the insulator 126 allows the securing mechanism 145 to apply an amount of torque for threadedly engaging the post 125 to retain the insulator 126, the post 125, and the fuse 100 in a fixed position.

Hence, during normal operating conditions, the electrical connection is formed between bus plate 132 and the fuse 100, but, no current flows through post 125. More specifically, a second end 175 of post 125 is isolated from an electrical connection between the fuse 100, the bus plate, and/or a terminal such that current is restricted from flowing through the second end 175. When an overvoltage or overcurrent event occurs, fuse element 136 is blown or otherwise breaks this electrical connection. In one embodiment, the post 125 defines several body portions.

Figure 3:
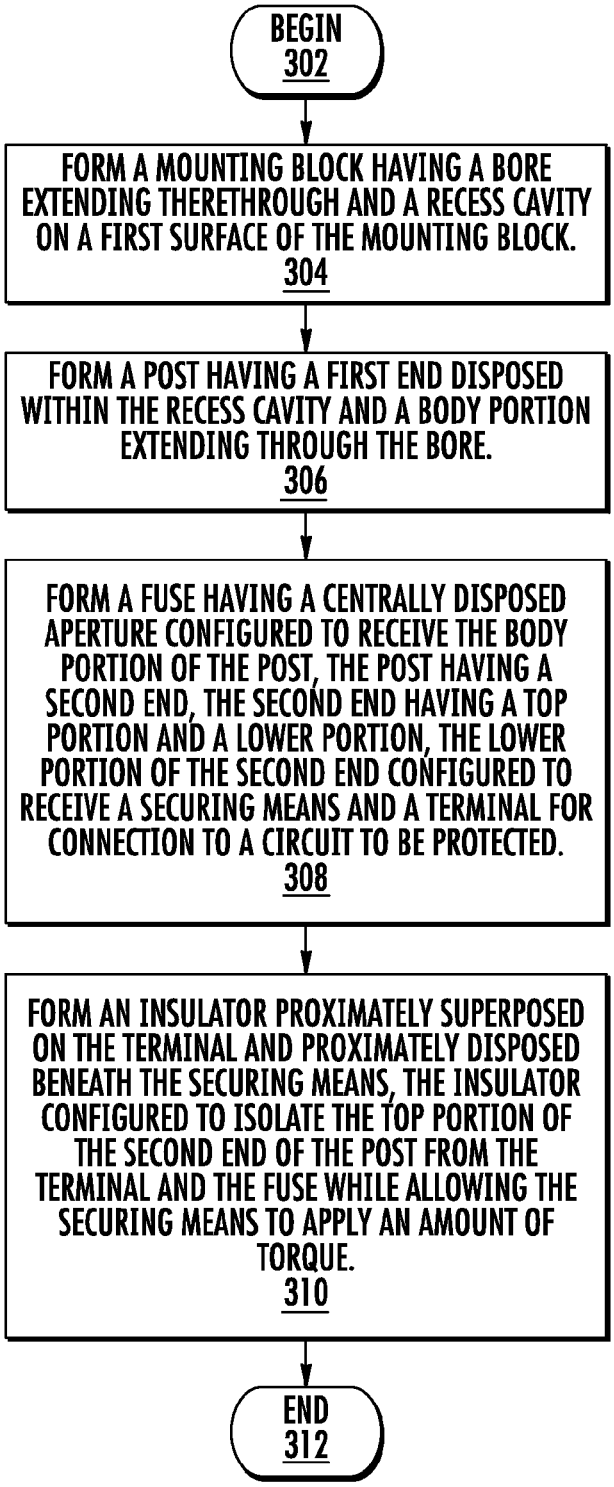
FIG. 3 is a flow chart of a method of manufacturing a mechanical disconnect switch with integrated fuse protection using the fuse assembly of FIGS. 2-4.

FIG. 3 is a flow chart of a method of manufacturing 300 a mechanical disconnect switch with integrated fuse protection using the fuse 100. In one embodiment, the method of manufacturing begins (302) by forming a mounting block having a bore extending therethrough and a recess cavity on a first surface of the mounting block (step 304). The mounting block is a mechanical disconnect switch having a switch assembly that is used to allow current to flow from a power source to a load. The method of manufacturing 300 forms a post having a first end disposed within the recess cavity and a body portion extending through the bore (step 306). The method of manufacturing 300 forms a fuse having a centrally disposed aperture configured to receive the body portion of the post, the post having a second end, the second end defined to have a top portion and a lower portion, the lower portion of the second end configured to receive a securing mechanism and a first terminal (or bus plate) for connection to a circuit to be protected (step 308). The method of manufacturing 300 forms an insulator proximately superposed on a first terminal and proximately disposed beneath the securing mechanism, the insulator configured to isolate the top portion of the second end of the post from the first terminal and the fuse while allowing the securing mechanism to apply an amount of torque (step 310). The isolation of the post from the fuse and the terminal creates an electrical circuit from the terminal to the use and to the mechanical disconnect switch and current is restricted from flowing through the post. The method of manufacturing 300 ends (step 312).

Thus, as described herein, the various embodiments described herein provide for a circuit protection assembly for a mechanical disconnect switch having integrated fuse protection. The circuit protection assembly comprising: a mounting block having a bore extending therethrough and a recess cavity on a first surface of the mounting block; a post having a first end disposed within the recess cavity and a body portion extending through the bore; a fuse having a centrally disposed aperture configured to receive the body portion of the post, the post having a second end, the second end having a top portion and a lower portion, the lower portion of the second end configured to receive a securing mechanism and a terminal for connection to a circuit to be protected; and an insulator proximately superposed on a first terminal and proximately disposed beneath the securing mechanism, the insulator configured to isolate the top portion of the second end of the post from the terminal and the fuse while allowing the securing mechanism to apply an amount of torque.

In one embodiment, the fuse includes an upper fuse terminal, a lower fuse terminal, and a fuse element disposed substantially orthogonal to the upper and lower fuse terminals, the upper fuse terminal having a centrally disposed aperture configured to align with the recess cavity such that the fuse is disposed partially around the mounting block, the fuse element is retained adjacent to a wall of the mounting block, the wall being disposed substantially orthogonal to the upper surface and a lower surface of the mounting block, and the lower fuse terminal is retained adjacent to the lower surface.

In one embodiment, a circuit protection assembly employs a post arrangement that is easier to manufacture and has a built-in insulating fuse configuration. A circuit protection assembly (CPA) is disposed between a source of power and a circuit to be protected. The CPA comprises a mounting block (which may be a mechanical disconnect switch having switch assembly) having a bore extending therethrough and a recess cavity on a first surface of the mounting block. A post having a first end is disposed within the recess cavity and a body portion extends through the bore. The body portion configured to receive a terminal (or bus plate) and the second end configured to receive a securing mechanism. A fuse having a centrally disposed aperture is configured to receive the body portion of the post and to receive the terminal for connection to a circuit to be protected. An insulator disposed on the terminal and disposed beneath the securing mechanism. The insulator configured to isolate the post from the terminal and the fuse while allowing the securing mechanism to apply an amount of torque.

In one embodiment, a circuit protection assembly includes a mechanical disconnect switch having a switch assembly, an upper surface and a lower surface. a plurality of posts each extending from the upper surface of the disconnect switch; a plurality of fuses each defined by a first terminal and a second terminal and a fuse element connecting the first terminal and the second terminal, each of the first terminals of the plurality of fuses having a centrally disposed aperture configured to receive a respective one of the plurality of posts; and at least one insulator proximately superposed on each one of the plurality of fuses and proximately disposed beneath a securing mechanism, the insulator configured to isolate the second end of the post from the terminal and the fuse while allowing the securing mechanism to apply an amount of torque.

In an alternative embodiment, a circuit protection assembly for a mechanical disconnect switch having integrated fuse protection comprises a mounting block having a bore extending therethrough and a recess cavity on a first surface of the mounting block; a post having a first end disposed within the recess cavity, a second end, and a body portion extending through the bore, the body portion configured to receive a terminal and the second end configured to receive a securing mechanism; a fuse having a centrally disposed aperture, the fuse configured to receive the body portion of the post and to receive the terminal for connection to a circuit to be protected; an insulator proximately superposed on the terminal and proximately disposed beneath the securing mechanism, the insulator configured to isolate the second end of the post from the terminal and the fuse while allowing the securing mechanism to apply an amount of torque.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

What is claimed is:

1. A circuit protection assembly for a mechanical disconnect switch having integrated fuse protection comprising:

a mounting block having a bore extending therethrough and a recess cavity on a first surface of the mounting block;

a post having a first end disposed within the recess cavity, a second end, and a body portion extending through the bore, the body portion configured to receive a terminal and the second end configured to receive a securing mechanism;

a fuse having a centrally disposed aperture, the fuse configured to receive the body portion of the post and to receive the terminal for connection to a circuit to be protected; and an insulator proximately superposed on the terminal and proximately disposed beneath the securing mechanism, the insulator configured to isolate the second end of the post from the terminal and the fuse while allowing the securing mechanism to apply an amount of torque, the insulator including a tether coupled thereto.

2. The circuit protection assembly of claim 1, wherein the insulator is a washer and the mounting block is a mechanical disconnect switch.

3. The circuit protection assembly of claim 1, wherein the insulator is configured to include a glass mat washer.

4. The circuit protection assembly of claim 1, wherein the insulator includes an extrusion portion extending along the body portion of the post and extending through the bore to isolate the second end of the post from the terminal and the fuse.

5. The circuit protection assembly of claim 1, wherein the fuse comprises a second terminal in contact with the terminal and a fuse element electrically connecting the terminal and the second terminal of the fuse.

6. The circuit protection assembly of claim 5, further including a bus plate disposed on the fuse below the terminal, the bus plate in contact with the terminal of the fuse.

7. The circuit protection assembly of claim 6, wherein the bore is a first bore, the post is a first post, and the terminal is a first terminal, the circuit protection assembly further comprising:

a second bore extending through the mounting block; and a second post having a first end in contact with the mounting block, a body portion extending through the second bore, and a second end configured to receive a third terminal disposed on the mounting block and a second end for connection to a circuit to be protected.

8. The circuit protection assembly of claim 7, further comprising a cover extending from the first terminal of the fuse to the second terminal of the fuse, wherein the cover is disposed over the fuse element.

9. A circuit protection assembly comprising:

a mounting block having a recess cavity in an upper surface of the mounting block;

a fuse having an upper fuse terminal, a lower fuse terminal, and a fuse element disposed orthogonal to the upper fuse terminal and the lower fuse terminal, the upper fuse terminal having a centrally disposed aperture configured to align with the recess cavity such that the fuse is disposed partially around the mounting block, the fuse element is retained adjacent to a wall of the mounting block, the wall being disposed orthogonal to the upper surface and a lower surface of the mounting block, and the lower fuse terminal is retained adjacent to the lower surface; and an insulator proximately superposed on the upper fuse terminal and proximately disposed beneath a securing mechanism, the insulator configured to isolate the securing mechanism from the fuse while allowing the securing mechanism to apply an amount of torque, wherein the insulator is a washer having a protective layer.

10. The circuit protection assembly of claim 9, further including a post having a first end disposed within the recess cavity, a second end, and a body portion extending through the centrally disposed aperture, the body portion configured to receive a terminal and the second end configured to receive the securing mechanism, wherein the insulator configured to isolate the securing mechanism from the fuse while allowing the securing mechanism to apply an amount of torque.

11. The circuit protection assembly of claim 9, wherein the washer includes an extrusion portion extending along the body portion of the post to assist in isolating the second end of the post from the terminal and the fuse while allowing the securing mechanism to apply the amount of torque.

* * * * *